United States Patent [19]

Lillibridge et al.

[11] 4,397,262

[45] Aug. 9, 1983

[54] APPARATUS FOR APPLYING AND DRYING SEALING MATERIAL TO THE SEAL FLAP OF ENVELOPES

[75] Inventors: Harold R. Lillibridge, Burlingame; John Sullivan, San Jose, both of Calif.

[73] Assignee: Champion International Corporation, Stamford, Conn.

[21] Appl. No.: 354,669

[22] Filed: Mar. 4, 1982

Related U.S. Application Data

[63] Continuation of Ser. No. 194,030, Oct. 6, 1980, abandoned.

[51] Int. Cl.[3] ..... B05C 21/00

[52] U.S. Cl. ..... 118/620; 219/10.69; 219/10.81

[58] Field of Search ..... 219/10.69, 10.81; 156/442.1; 34/1; 118/642, 620; 198/626

[56] References Cited

U.S. PATENT DOCUMENTS

| | | | |
|---|---|---|---|
| 2,706,233 | 4/1955 | Yamaguchi | 219/10.81 |
| 2,802,085 | 8/1957 | Rothacker | 219/10.81 |
| 3,109,080 | 10/1963 | Pungs et al. | 219/10.81 |
| 3,265,265 | 8/1966 | Lewis | 198/626 |
| 3,511,361 | 3/1970 | Urban | 198/626 |
| 3,952,421 | 4/1976 | Wilson et al. | 219/10.81 |
| 3,965,851 | 6/1976 | Cohn | 118/620 |
| 4,055,295 | 10/1977 | Cohn | 219/10.81 |
| 4,117,699 | 10/1978 | Renant | 198/626 |
| 4,210,977 | 7/1980 | Lillibridge | 118/203 |
| 4,218,830 | 8/1980 | Grassman | 219/10.81 |

*Primary Examiner*—Norman Morgenstern
*Assistant Examiner*—Richard Bueker
*Attorney, Agent, or Firm*—Evelyn M. Sommer

[57] ABSTRACT

An apparatus for applying latex areas to the seal flaps of paper envelopes and drying the latex is adapted to be placed either "in-line" or "off-line" with respect to a die-cut high speed envelope manufacturing machine. The apparatus includes a rotatable electrically insulated drum which acts as the ground for a radio frequency dryer (dielectric dryer) whose positive electrodes are adjustably spaced from the drum surface. The envelopes, during application of the latex and its drying, are held between flexible belts having projecting guides and are conveyed, still between the belts, by the rotating drum beneath the electrodes, with the latex exposed to the radio frequency drying.

9 Claims, 8 Drawing Figures

APPARATUS FOR APPLYING AND DRYING SEALING MATERIAL TO THE SEAL FLAP OF ENVELOPES

This application is a continuation of prior application Ser. No. 194,030, filed Oct. 6, 1980, now abandoned.

BACKGROUND OF THE INVENTION

The present invention relates to apparatus for the production of paper envelopes and more particularly to apparatus for the application and drying of latex gum to the seal flaps and body portions of such envelopes.

One type of paper envelope, which may be available in a variety of sizes and configurations, is "self-sealing", i.e., its user-sealable flaps (seal flaps) may be joined by pressure to the body portions of the envelopes. Such envelopes are an alternative to those that are sealed by applying moisture to an adhesive strip on a sealable flap.

The machines for applying and drying the latex gum (latex) are adapted to be compatible in speed of operation with the machines which form the envelopes. Such forming machines die-cut the paper stock to form a blank, fold the cut envelope blank and adhere the required portions to form the envelope.

For example, U.S. Pat. No. 3,915,881, which names Robert Cohn as inventor, entitled "Apparatus For Applying Sealing Material To Envelopes", shows an apparatus for applying latex sealing material (otherwise known as latex gum or latex) to the closure flap (seal flap) and opposite body portion of an envelope. The apparatus utilizes a conveyor belt having a triangular path, a latex applier and a dielectric dryer.

OBJECTIVES AND FEATURES OF THE INVENTION

It is an objective of the present invention to provide an apparatus to apply and dry the latex gum on the seal flaps of paper envelopes, which apparatus will operate at a relatively high rate of speed.

It is a further objective of the present invention to provide an apparatus to apply and dry the latex gum on the seal flaps of paper envelopes, which apparatus is adapted to be positioned, and operate, in-line in conjunction with standard envelope producing machines, such as the Champion (trademark of F. L. Smithe Machine Co.) "MO" (Medium Open End Machine).

It is a further objective of the present invention to provide an apparatus to apply and dry the latex gum on the seal flaps of paper envelopes, in which apparatus the envelopes are conveyed by a drum so that the path of travel of the envelope is relatively short and the apparatus is relatively compact.

It is a still further objective of the present invention to provide an apparatus to apply and dry the latex gum on the seal flaps of paper envelopes, which will operate in a rapid and efficient manner and which will handle a wide variety of sizes and configurations of envelopes.

It is a still further objective of the present invention to provide an apparatus to apply and dry the latex gum on the seal flaps of paper envelopes, which utilizes a single conveyor means for conveying the envelopes in a continuous process, thereby avoiding the loading and unloading of envelopes into a number of machines.

It is a feature of the present invention to provide an apparatus for applying and drying the adhesive (latex) portions on envelopes which are die-cut, folded and formed by an envelope producing machine. The apparatus includes means for applying the latex to the seal flap and body of the envelope and a dielectric dryer comprising a radio frequency (RF) generator and a radio frequency electrode. Preferably the radio frequency positive electrode comprises a plurality, for example, twenty-four, rods which are parallel to each other and with each rod adjustably connected to a common base.

The apparatus further includes a rotatable drum which acts as the ground (ground plate) for the dielectric heater. Preferably the drum is electrically isolated from its shaft to prevent RF losses. Preferably the drum shaft is driven from the envelope producing machine.

The apparatus also includes means to collect and convey the envelopes, which preferably is a plurality of endless conveyor belts. Preferably the belts comprise a wide bottom belt and two narrower top belts. Preferably each of the belts is guided by an elongated projection on its rear side which fits in grooves in the guidance wheels and, in the case of the bottom belt, fits in a groove (guide track) of the drum. The entire apparatus is RF shielded by an enclosure and RF shield material and the belts pass through enclosures (vestibles) on entering and leaving the dielectric heater. The latex is applied preferably by an air bar gummer.

BRIEF DESCRIPTION OF THE DRAWINGS

Other objectives and features of the present invention will be apparent from the following detailed description of the invention which should be taken in conjunction with the accompanying drawings.

In the drawings.

DETAILED DESCRIPTION OF THE INVENTION

The machine of the present invention is adapted to apply liquid latex adhesive to the seal flaps of a variety of types of envelopes and to dry the latex.

Figure 1:
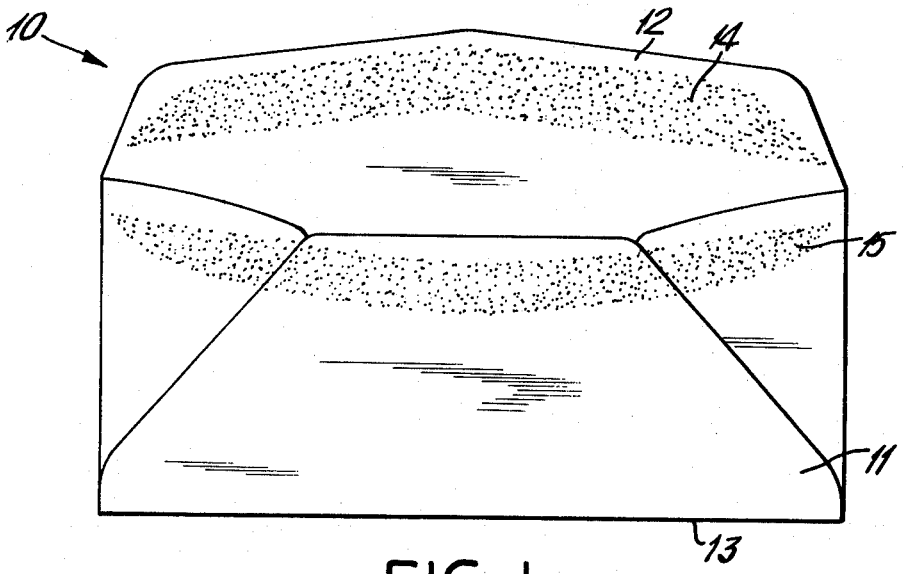
FIG. 1 is a top plan view of one type of envelope which may be processed by the apparatus of the present invention.

One of the types of envelopes which may be processed in the machine of the present invention is illustrated in FIG. 1, in which the envelope 10 includes three folded-over sections which are joined and adhered by two glue lines in a machine (not shown) prior to the machine of the present invention. The envelope 10 has a closure flap (seal flap) 12 which is opposite to its bottom folded edge 13. A line (strip) of latex sealing material 14 is applied along the closure flap 12 and a similarly configured line of latex sealing material 15 is applied along the body portion 11 of the envelope. When the envelope is to be used, a letter, or other material, is inserted within the body portion 11 and the closure flap 12 is folded over. The latex strip 14 is fastened to the latex strip 15 by pressure and without water.

Figure 2:
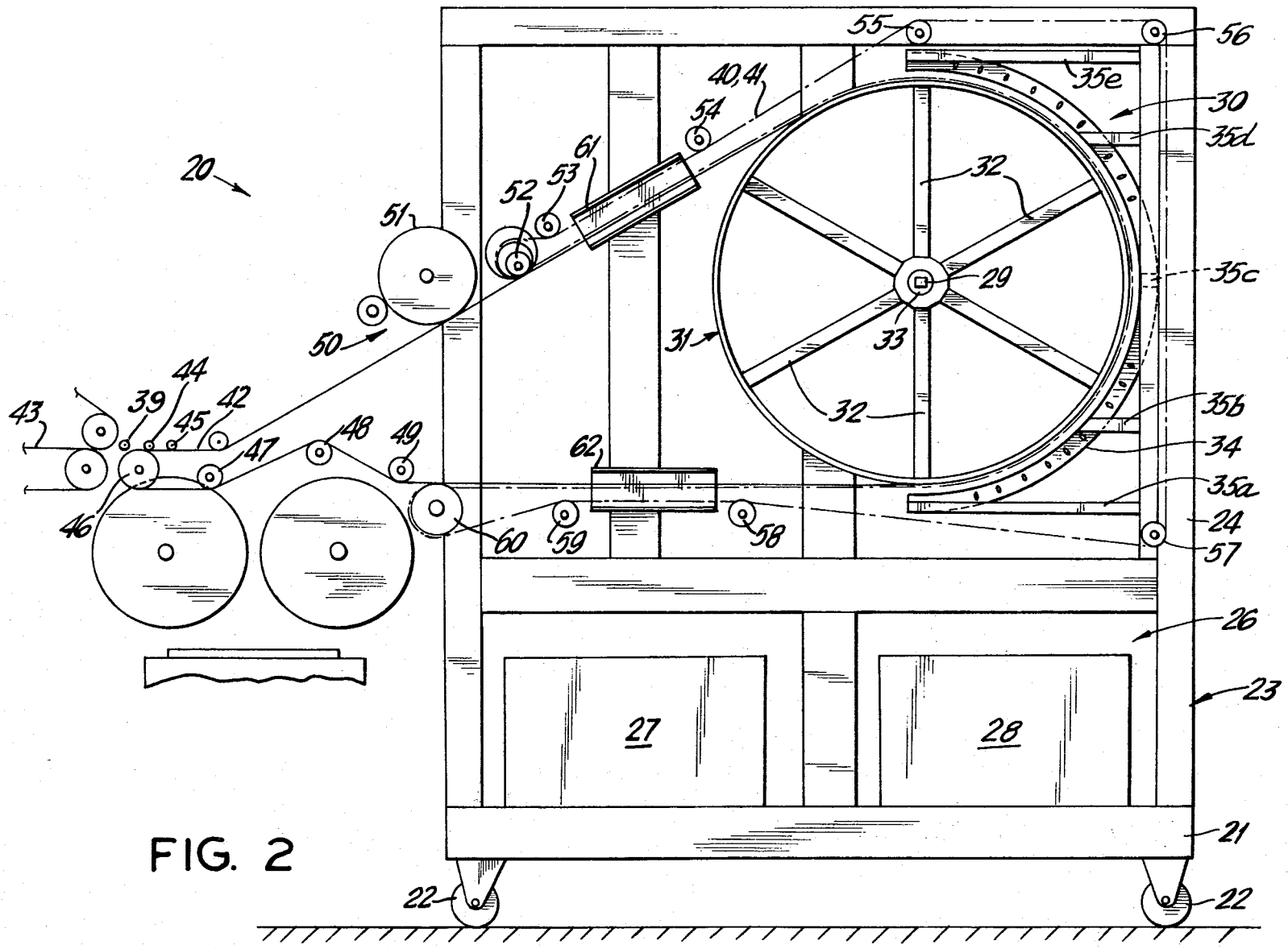
FIG. 2 is a side plan view of the apparatus of the present invention.
Figure 3:
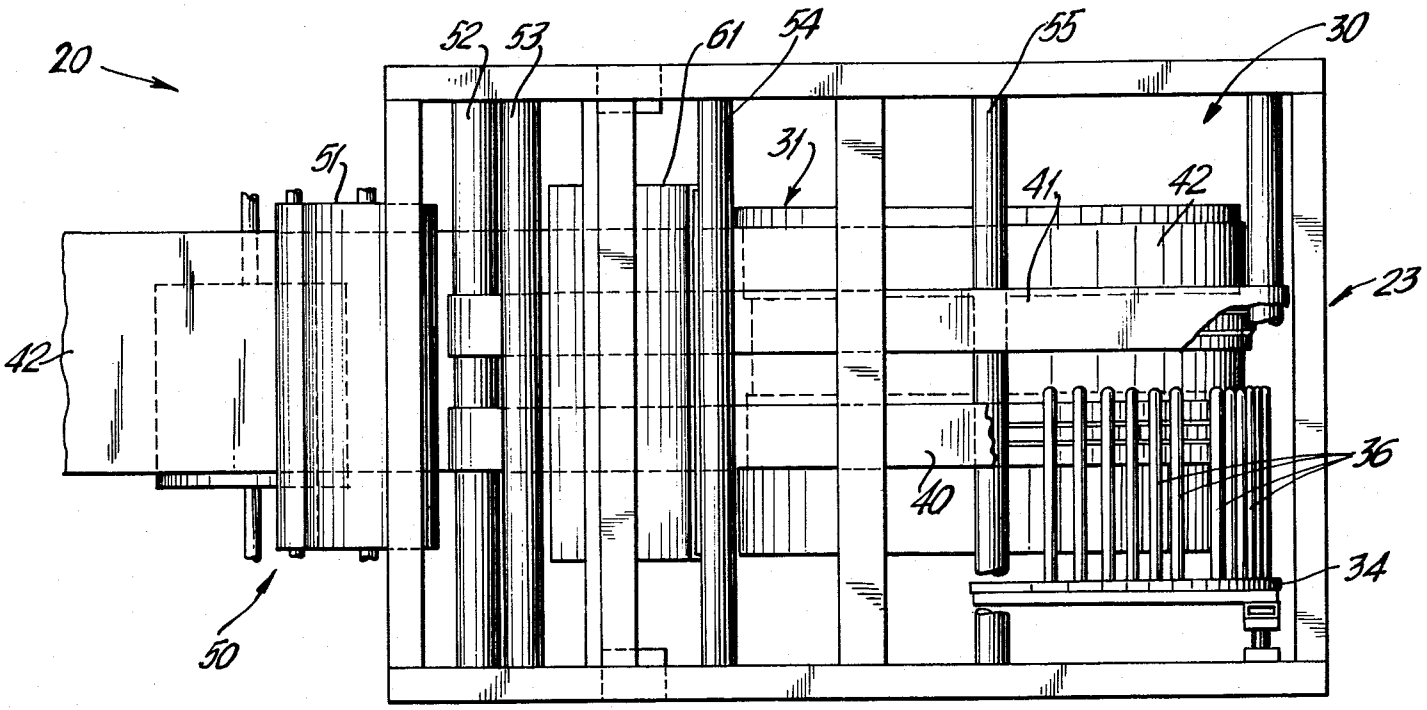
FIG. 3 is a top plan view of the apparatus of FIG. 2.

The apparatus 20 of the present invention applies the latex strips 14 and 15 and dries them. The apparatus, as shown in FIGS. 2 and 3, includes a base 21 which is positioned on casters 22. The latex applying and drying apparatus 20 may be moved on its casters 22 to its installed position in the envelope production line next to the delivery table.

The apparatus of the present invention may be used with various types of envelope producing machines. For example, the apparatus of the present invention may be positioned on-line at the delivery table of a Champion (trademark of F. L. Smithe Machine Co.) "MO" machine (medium open end machine) manufactured by F. L. Smithe Machine Co., Duncansville, Pa., which is a die-cut open machine producing center seam open end envelopes or double side sean envelopes at a range of up to 200 per minute on a wide variety of envelopes. Alternatively, the apparatus of the present invention may be used "off-line", i.e., as an independent unit for batch production.

A frame 23 is fixed to the base 21 and comprises vertical frame members 24 and horizontal frame members 25. The frame members form a bottom section 26 in which is positioned the radio frequency power supply 27 and the radio frequency generator 28. The radio frequency generator 28 is preferably a 4-kilowatt generator which produces radio frequency at 27 megahertz and with a voltage between 2000 and 12,000 volts. A suitable radio frequency generator and its power supply is available from the Thermex Division (A Company Of Solidyne, Inc) of Santa Clara, Calif. The radio frequency generator 28 supplies radio frequency power to the dielectric dryer which dries the latex strips 14 and 15 on the envelope 10. The latex gum is a low-salt gum to avoid arcing and, for example, may be composed of water, ammonia and latex.

The frame 23 also forms an upper section 30 in which a drum 31 is rotatably mounted. The drum 31, which is of conductive metal and is the ground (plate) is described in further detail below. The drum 31 is secured by spokes 32 to a central hub 33. The drum is electrically insulated (isolated) from its shaft. The exterior face of the drum 31 is spaced from the electrodes 36, which act as positive electrodes. The electrodes 3 are mounted, at one of their ends, in the electrode holder 34. The electrodes 36, preferably twenty-four in number, are of conductive metal, as is the electrode holder 34. The electrode holder 34 is spaced from its vertical metal frame member 24 by a series of non-conductive supports 35*a* through 35*e*. The supports 35*a* through 35*e* are preferably constructed of a plastic resin impregnated material, so they are strong and electrically insulative. For example, the supports 35*a* through 35*e* may be of a laminated silicone resin impregnated glass fiber reinforced material, for example, a dense non-conductive material called "Synthane" (NEMA Designation G-7; Government Specifications IP-509, MIL-P-997), available from the Synthane Taylor Company of Valley Forge, Pa.

Figure 6:
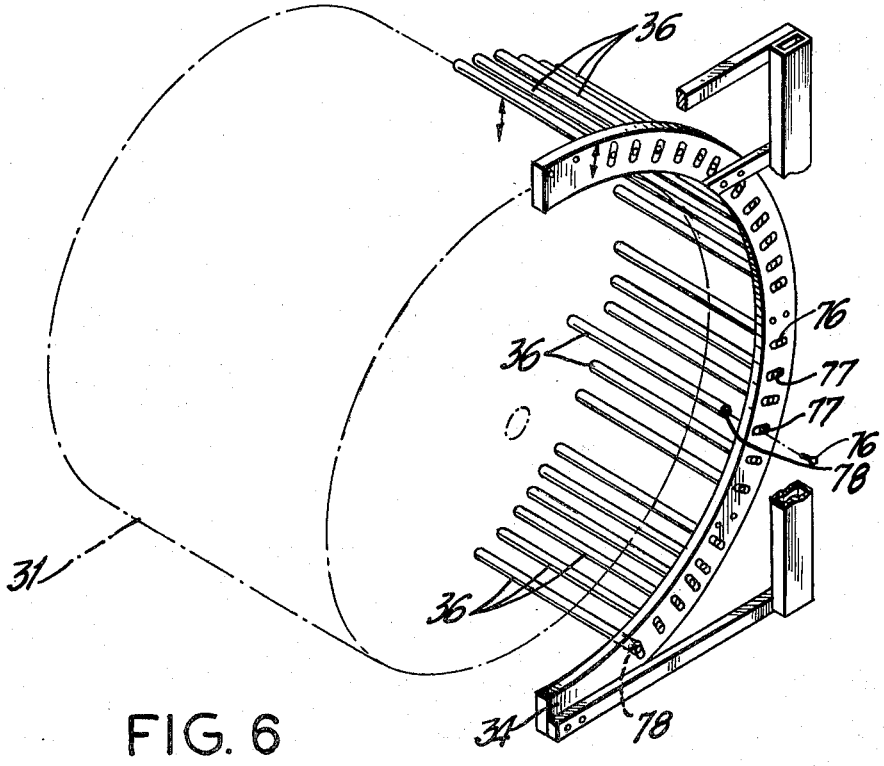
FIG. 6 is a perspective view of the electrode base and the electrodes utilized in the apparatus of the present invention.

The structure of the electrodes 36 and the electrode holder 34 (base) is shown in FIG. 6. Each electrode 36 is a bar member which is round in cross-section and has a blunt outer free edge. The end of the electrode 36, which is connected to the electrode holder 34, has a drilled and tapped hole 78. A bolt 76 has its head on one side of the electrode holder 34 and extends its shaft through an elongated slot 77 of the electrode holder 34 and is connected into the hole 78 of the electrode 36. The bolt 76 may be loosened so that the electrode may be moved either toward, or away, from the drum within the elongated slot 77 of the electrode holder 34, and then re-tightened. Each of the twenty-four electrode 36 is mounted in the same manner to the electrode holder 34 so that each electrode 36 may individually be adjustably moved toward or away from the drum 31.

Figure 4:
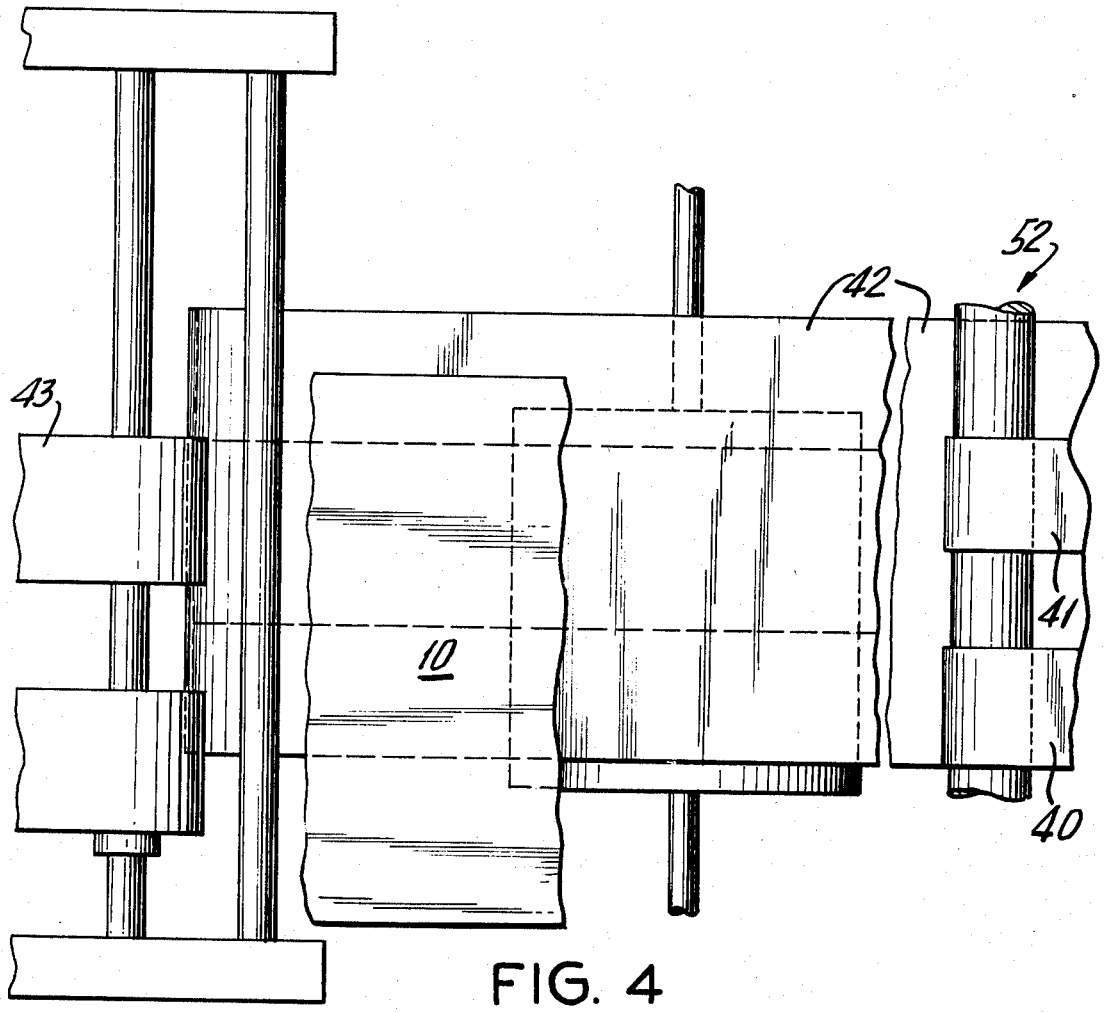
FIG. 4 is an enlarged top plan view showing the conveyor belts utilized in the apparatus of the present invention.

A plurality of belts of the endless conveyor type, shown in FIG. 4, are mounted on the exterior surface of the drum 31. The belts consist of a first top belt 40, for example, 7 inches in width; a second top belt 41, for example, 4 inches in width and spaced from the first top belt by about $\frac{1}{2}$ inches and parallel thereto; and a bottom belt 42, for example, of $12\frac{5}{8}$ inches in width. The belts 40–42 are positioned so that the envelopes are carried between the top belts 40 and 41 and the bottom belt 42. As shown in FIG. 4, the outer edges of the first top belt 40 and the bottom belt 42 are aligned so that both the latex strip 14 (on the closure flap 12) and the latex strip 12 (on the body portion 11) extend beyond the aligned edges of the first top belt 40 and the bottom belt 42. This positioning of the envelope is required so that there are no belts between the electrodes 36 carrying the radio frequency power and the drum 31, which acts as the ground, when the envelope is conveyed within the dielectric dryer. The first top belt 40 and the second top belt 41 hold the body of the envelope.

The belts 40–42 are preferably of a strong rubber reinforced cloth material which is flexible and yet will not stretch. The surface of the belt which holds the envelopes preferably has a checkered pattern of cavities. The belts 40–42 each have a guidance projection with sloping sides along the entire length of their rear faces. A suitable belt is available from the Victor Balata Belting Co. of Easton, Pa., and consists of a rubber impregnated fiber textile belt having a smooth inner surface and a pocketed outer surface which grips the envelope, i.e., in a friction grip. The back of the belt has an integral projection along its length which guides (tracks) the belt and fits in grooves in the guidance and drive rollers.

As shown in FIG. 2, the bottom belt (inner belt) 42 picks up the envelope at the exit of the conveyor 43 of the envelope forming machine. For example, as mentioned above, the envelope forming machine may be an "MO" machine, a medium open end machine manufactured by F. L. Smithe Company of Duncansville, Pa., which produces a high volume of center-seam open-end envelopes. The drive for the various wheels of the latex applying and drying machine 20 is preferably taken from the envelope producing machine through a suitable gear box (not shown).

The envelopes from the conveyor 43 are moved onto the bottom belt 42 by a series of small driven rotating cylinders (rollers 39, 44 and 45). The bottom conveyor belt 42 is driven by the drive cylinder 46 and is guided in its path by a series of guide cylinders, including the guide cylinders 47, 48 and 49. The guide cylinder 48 is vertically movable so as to adjust the tension in the bottom belt 42.

Figure 7:
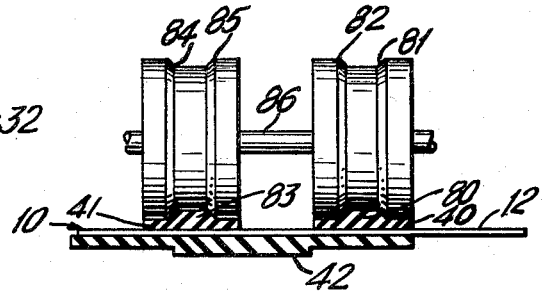
FIG. 7 is a side sectional view showing the arrangement of the conveyor belts and a roller.
Figure 8:
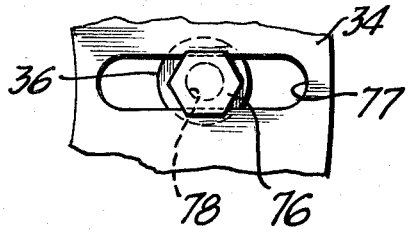
FIG. 8 is an enlarged side view of a portion of the electrode base.

Each of the cylinders, as shown in FIG. 7, consists of two rollers mounted on a common shaft. Each roller has a guide track (guidance groove) which guides the elongated guide projections on belts. The first top belt 40 has projection 80 which rides in guide track 81 of roller 82 and the second top belt 41 has projection 83 which rides in guide track 84 of roller 85, the rollers 84 and 85 being fixed to the common shaft 86 and constituting a guide cylinder or a drive cylinder, the construction being the same.

The envelopes, which are held on the belt 42 by friction are brought to a gummer station 50, in which the latex strips, for example, the latex strips 14 and 15, are applied to the envelope. The gummer station preferably includes an air bar gummer 51 which may be of the type described in detail in the patent entitled "Air Cleaning Apparatus", U.S. Pat. No. 4,210,977, incorporated by reference herein.

After the latex is applied at the gummer station 50 the envelopes are positioned between the top belts 40 and 41 and the bottom belt 42. The top belts 40 and 41 are guided at the end of their travel by the cylinders 52 and 53. The return path of the top belts 40,41 is determined by the guidance cylinders 52–59 and the turn-around cylinder 52.

The first top belt 40 holds the body of the envelope; and the second top belt 41, spaced apart from the first top belt, holds the flap down. The width of the top belts are preferably 7 inches, for belt 40, and 4 inches, for belt 41; the spacing between them is preferably ½ inches and the width of the bottom belt is preferably 12⅝ inches; these dimensions providing belts whose spacings do not require any changes or adjustments even when a large variety of sizes and shapes of envelopes are produced on the apparatus.

The belts 40–42 at the entrance and exit of the latex applying and drying machine 20 are conveyed through a top vestibule 61 and a bottom vestibule 62. The vestibules 61,62 and the entire apparatus is electrically shielded, for example, by RF shielding from Metex Co., New Jersey, to avoid radio frequency power loss. The latex applying and drying machine 20 is complete enclosed in a conductive metal enclosure fixed to the frame 23 so as to avoid leakage of radio frequency energy outside of the machine. The vestibules 61 and 62 which are, in effect, orifices into and out of the dielectric dryer portion of the machine 20, prevent radio frequency energy from exiting from the dielectric dryer. The vestibules have openable doors which are retained in place by quick release screws for rapid access in case of a jam.

For safety, the RF power is automatically shut off when any of the panels, for example, the doors of the vestibules 61,62, are opened.

Figure 5:
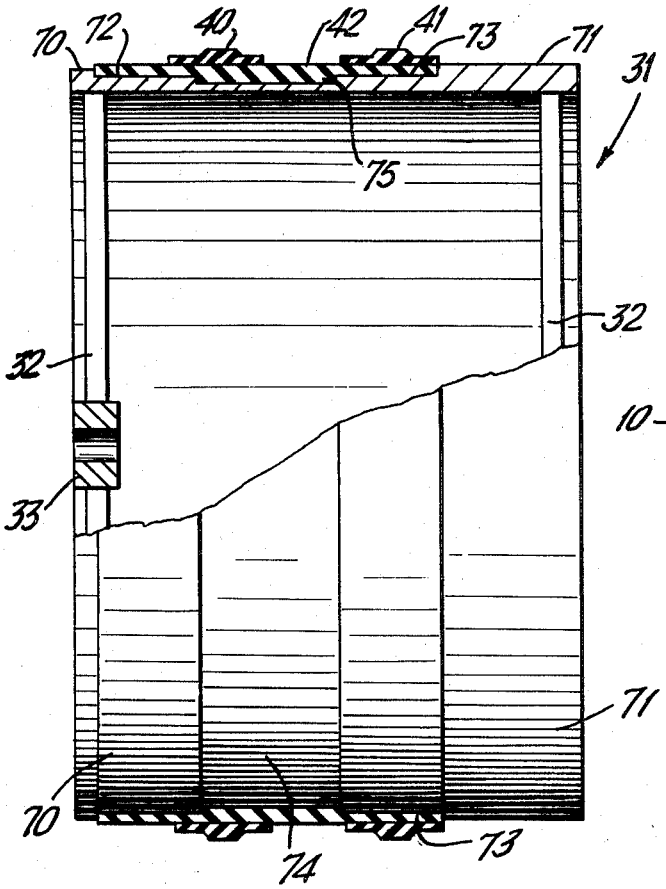
FIG. 5 is a cut-away top plan view of the drum utilized in the apparatus of the present invention.

The drum 31 is shown in greater detail in FIG. 5, which also shows its relationship to the belts 40–42. It is of a conductive metal. The surface of the drum 31 has a series of circumferential steps which are used to guide the bottom belt 42. For that purpose the drum 31 has a narrow raised lip 70 and an opposite wider raised lip 71. It also has a first depressed step portion 72 (next to the lip 70) and on the same level an opposite step portion 73 (next to the lip 71). A second even further depressed step portion 74 is formed between the step portions 73 and 72. The bottom belt 42 has along its entire length an inboard, i.e., inwardly directed, ridge 75 which is fixed to the belt. The ridge 75 fits within the step 74 and acts as a guide for the bottom belt 42. The steps 72 and 73 (formed between the lips 70 and 71) guide the outer edges of the bottom belt 42. The hub 33 of the drum 31 is mounted on a drum shaft 29 whose ends freely rotate in bearings mounted to the frame 23.

An electronic counter (not shown) counts the envelopes as they exit from the machine. For example, the counter may consist of a photocell and solenoid operated counter.

What is claimed:

1. An apparatus for drying the adhesive portions on envelopes produced by an envelope producing machine, said apparatus comprising:

a radio frequency generator and connected thereto a radio frequency electrode;

a rotatable drum which is an electrical ground with respect to said electrode and spaced therefrom; and means to collect and convey the envelopes having undried adhesive portions to said drum so that said portions are dried by radio frequency power as they are conveyed by the drum beneath said electrode;

said electrode comprising a plurality of conductive electrode rods, each rod attached at only one end thereof to a base which extends in an arc along one side of said drum, each of said rods being a straight elongated rod arranged parallel to the other rods;

each of said electrode rods having an end portion extending through an elongated slot in said base and being fixedly attached to said base by securement means received on said end portion along the axis of said rod, each of said elongated slots in said base extending along a radius of said drum, and each of said electrode rods extending inwardly over, around, and partially across said drum to form an arc proximate and spaced from the surface of said drum;

whereby each electrode rod is attached to said base by adjustment means including said end portion and securement means whereupon by loosening of said securement means, said rod may be adjusted prior to use to permit movement of each rod individually either toward or away from the surface of said drum.

2. An apparatus for drying the adhesive portions on envelopes as in claim 1 wherein said drum is a conductive metal drum mounted on a hub, with the hub mounted on a shaft and with the drum electrically insulated and radio frequency shielded from said shaft.

3. An apparatus for drying the adhesive portions on envelopes as in claim 2 wherein said drum is rotated by a motor means of said envelope producing machine.

4. An apparatus for drying the adhesive portions on envelopes as in claim 3 wherein said envelope producing machine is a high-speed die-cut machine.

5. An apparatus for drying the adhesive portions on envelopes as in claim 1, wherein the adhesive portions are latex strips and the apparatus further comprises means for applying said latex gum strips.

6. An apparatus for drying the adhesive portions on envelopes as in claim 5 wherein said latex strip applying means is an air bar gummer.

7. An apparatus for drying the adhesive portions on envelopes as in claim 1 wherein the means to collect and convey the envlopes includes a bottom endless conveyor belt and at least one top endless conveyor belt with the envelopes being held therebetween.

8. An apparatus for drying the adhesive portions on envelopes as in claim 7 wherein the envelopes are held by two top endless belts which are parallel and spaced apart and overlie the bottom belt.

9. An apparatus for drying the adhesive portions on envelopes as in claim 7 wherein each of said belts has an elongated projection along its surfaces opposite the surface in contact with the envelopes, the projection of said bottom belt cooperating with guide tracks in the drum to guide the projection of said bottom belt.

* * * * *